US007546755B2

(12) United States Patent
Arns

(10) Patent No.: US 7,546,755 B2
(45) Date of Patent: Jun. 16, 2009

(54) STRUCTURAL COMPONENT

(75) Inventor: Wilhelm Arns, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 205 days.

(21) Appl. No.: 11/652,189

(22) Filed: Jan. 11, 2007

(65) Prior Publication Data

US 2007/0119525 A1 May 31, 2007

Related U.S. Application Data

(62) Division of application No. 10/666,958, filed on Sep. 19, 2003, now Pat. No. 7,181,948.

(30) Foreign Application Priority Data

Oct. 2, 2003 (DE) ..... 102 46 164

(51) Int. Cl.
*B21B 1/00* (2006.01)

(52) U.S. Cl. ..... 72/203; 72/206; 72/240; 72/365.2

(58) Field of Classification Search ..... 72/203, 72/206, 240, 365.2, 264, 379.6
See application file for complete search history.

(56) References Cited

U.S. PATENT DOCUMENTS

| | | | | | |
|---|---|---|---|---|---|
| 1,838,116 | A | * | 12/1931 | Sheehan | 72/340 |
| 2,184,150 | A | * | 12/1939 | Parker et al. | 148/652 |
| 3,339,908 | A | * | 9/1967 | Komarnitsky | 267/47 |
| 4,248,072 | A | * | 2/1981 | Hasegawa et al. | 72/8.3 |
| 6,675,618 | B2 | * | 1/2004 | Matsuzaki | 72/16.2 |

* cited by examiner

*Primary Examiner*—Edward Tolan
(74) *Attorney, Agent, or Firm*—Andrew Wilford

(57) ABSTRACT

Elongated structural components having regions of different thicknesses, especially for use in automobile bodies, are produced by flexible rolling metal strip so as to form along a length thereof rolled-strip segments of different wall thickness. The sheet bars are cut from the rolled strip and have regions of different wall thickness. Each sheet bar is reshaped in at least one hot-forming tool in at least one hot-forming state and the reshaped sheet bar is then rapidly cooled in the hot-forming tool of the last reshaping stage.

6 Claims, 1 Drawing Sheet

STRUCTURAL COMPONENT

CROSS REFERENCE TO RELATED APPLICATION

This application is a division of application Ser. No. 10/666,958 now U.S. Pat. No. 7,181,948 filed 19 Sep. 2003 with a claim to the priority of German application DE 102 461 64.8 filed 2 Oct. 2002.

FIELD OF THE INVENTION

The present invention relates to a method of making structural components and the structural components made by the method. More particularly the invention relates to the production of structural components in the form of sheet bars, i.e. elongated members produced from metal strip and especially such members that can have regions or segments of different wall thickness to match, for example, different load expectations on the structural element.

BACKGROUND OF THE INVENTION

Structural components for automobiles, for example, often are important from the point of view of safety and frequently are required to have specific deformation properties in the case of a crash. Such components must have greater yieldability at certain points and must be more resistant to deformation at other regions, even though they may be in the form of sheet bars, i.e. elongated members that may have different shapes or cross sections. In more general terms, such structural elements must have stronger and weaker regions to allow deformation energy to be dissipated in a defined manner. In spite of the fact that such bars or structural elements may have to have stronger and weaker regions, they nevertheless should be fabricated in one piece.

To produce structural components that are optimally matched for a crash situation, German patent document DE 100 49 660 A1 discloses a so-called patchwork sheet bar in which the basic sheet metal structure is reinforced at certain locations by reinforcing plates that are bonded to the basic structure to form a composite at those locations. The resulting patched composite can be heated to a temperature of about 800 to 850° C. and then subjected to a reshaping in the hot state and then, while being locked into the reshaped state is cooled in a defined manner with the reforming tool and thereby hardened. The production of the composite is however expensive and time-consuming as a result of the need to join the reinforcing plates to the basic sheet metal structure.

In addition to this patchwork method, DE 199 62 754 A1 discloses a method of flexible rolling a metal strip in which during the rolling process different wall thickness regions are formed on the strip. The strip with these regions of different wall thicknesses can then be cut to form components with the different wall thicknesses. To avoid temperature-based variations in the thickness and the longitudinal profile of the metal strip, during the rolling a compensation for the various temperature influences on the strip is effected to avoid deviations from the set-point thickness and/or set-point lengths of the individual strip segments at a predetermined final temperature of the strip. If the different thicknesses in the strip are characterized by markings in the middle strip, for exact positioning of the cut contours of the sheet bar products, this method can be used to produce such sheet bar products both as rectangular and as bars of other shapes in a reproducible manner. Nevertheless this method is not fully satisfactory for the production of elongated structural components that are to have optimal deformation properties as parts of a motor vehicle body or chassis in the case of a crash.

OBJECTS OF THE INVENTION

It is thus the principal object of the present invention to provide an improved method of making an elongated structural component having regions of different thicknesses along a length thereof whereby advantages of the prior art techniques can be retained while drawbacks thereof are avoided.

Another object of the invention is to provide an improved method of making such structural components that is economical and yet capable of the mass production of especially motor vehicle components that are to have defined deformation properties without the need for joining reinforcing plates to basic sheet bar structures.

Another object of the invention is to provide an improved sheet bar product that has defined deformation properties.

SUMMARY OF THE INVENTION

These objects are attained by a method of making an elongated structural component having regions of different thicknesses along a length thereof matched to different loads adapted to be applied to this component, the method comprising the steps of:

(a) rolling metal strip so as to form along a length thereof rolled strip segments of different wall thickness;

(b) cutting from the rolled strip sheet bars having regions of the different wall thicknesses formed by rolling in step (a) and matched to different loads to be applied to the component;

(c) reshaping each sheet bar cut from the rolled strip in step (b) to a final configuration of the respective structural component in at least one forming step in at least one hot-forming tool; and (d) hardening the respective reshaped sheet bar thereof in the respective hot-forming tool.

In accordance with the invention, the flexible rolled metal strip is provided during he rolling operation with defined different thicknesses over its length and markings are provided on the strip to permit the alignment of the cutting operation with the regions of different thicknesses so that a sheet bar punched, stamped or laser cut from the strip will have the regions of greater and lesser thicknesses at the precise locations required in the structural component that is ultimately formed. The cutout sheet bars are then reformed in a hot-forming process to the final configuration of the structural component and are hardened as they are held following the last reforming stage in the tool thereof. The sheet bar or the preformed structural component shaped from this sheet bar is clamped between two tool members during the last reforming stage or is urged in a pressing operation against and into a tool member during the last reforming operation.

The pressing is carried out generally in less than 5 seconds and the chilling of the workpiece from the hot-forming temperature is carried out while the workpiece is in the tool and so rapidly that a desirable fine-grained martensitic and/or bainitic structure is obtained. The chilling speed of course, depends upon the composition of the steel that is used and, of course, upon the time/temperature diagram of that steel and the transformation of the martensitic and/or bainetic structures. At the end of the rapid cooling, the workpiece is still in the press since the press serves not only for the last shaping state but also to hold the workpiece during its cooling down. Because the workpiece is clamped in the tool during the cooling down, the final dimensions imparted by the tool are maintained.

The hot forming and cooling (hardening) of the workpiece in the tool can utilize the principles disclosed in the commonly-owned copending patent applications Ser. No. 10/395,309 and Ser. No. 10/395,716, both filed 24 Mar. 2003.

The use of the hot-shaping process on sheet bars cut from a metal strip having different thicknesses along its length, enables the fabrication of hot-shaped products with predetermined dispositions of the sheet thickness and enables structural components of predetermined strength and properties to be produced with a weight-saving of 20 to 50%. Because the structural component has predetermined weakened zones, the folding properties can be controlled with precision upon a crash and thus the manner in which the crash energy is absorbed or dissipated can be controlled more precisely than heretofore.

The sheet thickness and thus the inertia property of the hot-shaped parts can be controlled accurately and can have a rapid reaction during crash tests in a predictable manner. It is especially important that the sheet thickness can be set and maintained with greater accuracy than heretofore with conventional hot or cold shaping methods. Since the sheet thickness is perhaps the most important criterium for the stiffness and folding properties of the structural component reproducibility is improved and crash test results are likewise more likely to be predictable. In addition, the attachment processes required for patched composites are no longer necessary.

It has been found to be advantageous during the cutting state to provide the thin regions of the strip with shaping elements functioning as stacking aids to compensate for sheet thickness differences. These shaped elements can be corrugations or folds that can be provided in opposite relationship from one another in each second sheet bar. This facilitates stacking and transport of the stacked sheet bars to the reshaping tool.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
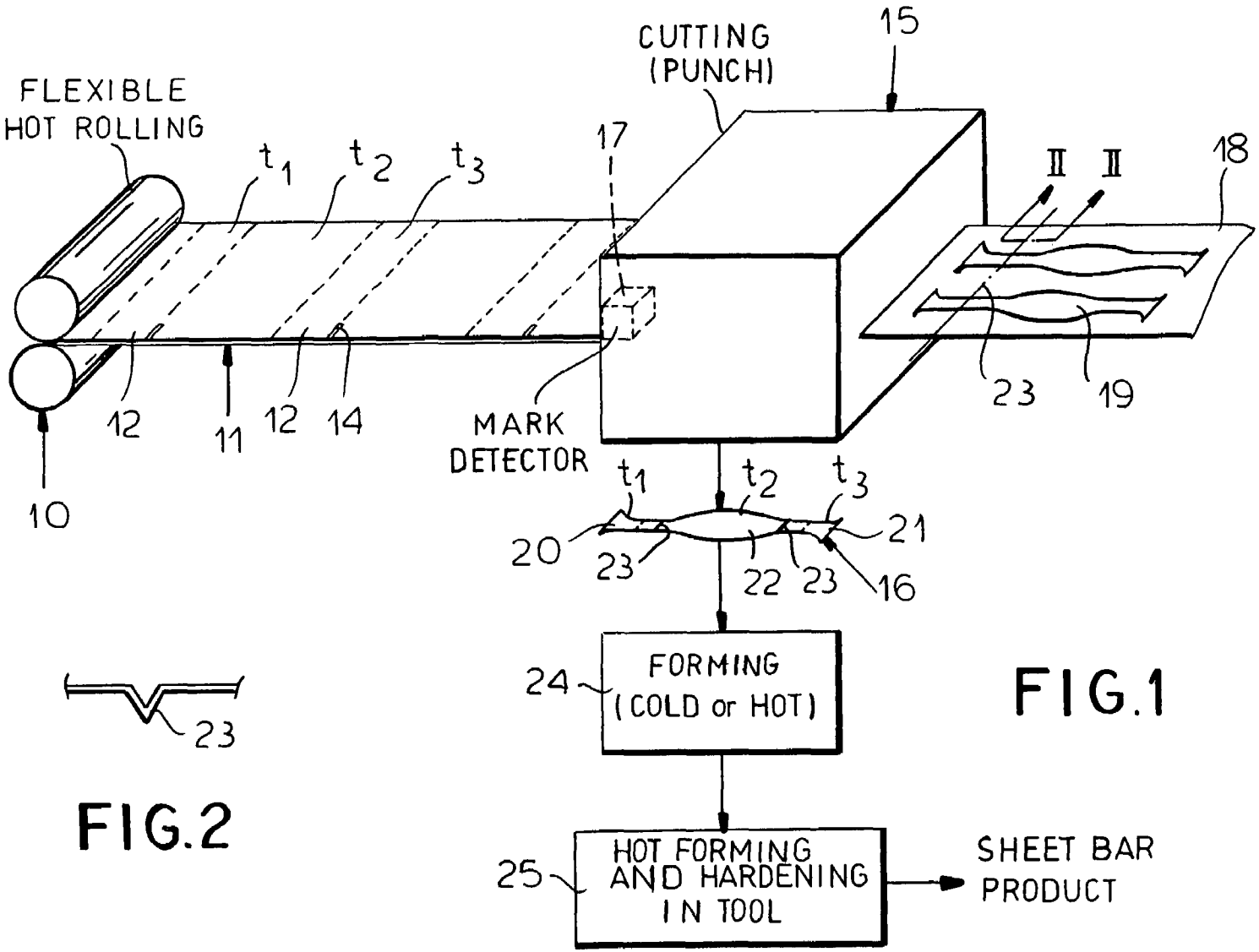
FIG. 1 is a diagram showing the method of the invention.
FIG. 2 is a cross sectional view taken along the line II-II of FIG. 1.

In FIG. 1 I have shown a system for producing sheet bar products with regions of greater thickness and regions of lesser thickness, e.g. for use in automobile bodies in which the regions of lesser thickness are adapted to fold preferentially and in a predictable manner to dissipate crash energy. The flexible hot rolling state is represented at 10 and produces a steel strip 11 with successive segments 12 and 13 of greater thicknesses $t_1$, $t_3$ and laser thickness $t_2$. During the flexible hot-rolling step, the strip is provided with marks 14 indicating the beginning of each region of greater thickness.

The strip is fed to a cutting stage 15 in which sheet bars 16 are stamped, punched or laser cut from the strip in precise alignment with the marking as detected by the mark detector 17. The web 18 emerging from the cutting stage can be recycled as scrap and may have cutouts 19 corresponding to the sheet bar 16. The sheet bars 16 have thick regions 20 and 21 and thin regions 22 and can be provided with stacking formations 23 that are staggered and may be produced in the strip so as to extend completely across the strip.

As shown in FIG. 2 such formations may be corrugations. The stacked sheet bars 16 are delivered to the forming stage 24 where they are subjected to one or more reforming steps in respective shaping tools or in a single progressively closed tool then, in tool for the last hot-forming step the sheet bar is subjected to rapid cooling or hardening as represented by stage 25.

In general, a hot-forming process consists of heating, hot-forming and hardening. If there are several hot-forming steps following one another, the part must be reheated between each step because the contact with the hot-forming tool cools the part down sufficiently to require such reheating. The hardening of this invention follows a hot-forming step and thus commences with that hot-forming step and is controlled in the last hot-forming step to provide the desired grain structure.

Simple structures can use a single hot-forming step.

More complicated structures, such as B-pillars, are usually preformed cold. The forming operation during hot-forming may be limited to a few percent to maintain tolerances during hardening. Thus where the forming carried out at 24 is a cold forming, the part is heated in the hot-forming tool 25 or prior to that hot-forming tool. Where the preforming step at 24 is a hot-forming, the final stage at 25 is likewise a hot-forming and the hardening.

I claim:

1. An elongated structural component having regions of different thicknesses along a length thereof matched to different loads to be applied to the component, the component being made by a method comprising the steps of:

(a) longitudinally rolling metal strip so as to form along a length thereof transversely extending rolled strip segments of different wall thickness;

(b) cutting from the rolled strip sheet bars extending longitudinally across a plurality of the segments and therefore having regions of the different wall thicknesses formed by rolling in step (a) and matched to the different loads to be applied to the component;

©) reshaping each sheet bar cut from the rolled strip in step (b) to a final configuration of the respective structural component in at least one forming step in at least one hot-forming tool; and (d) hardening the respective reshaped sheet bar thereof in the respective hot-forming tool.

2. The component defined in claim 1, the method further comprising the step of marking longitudinally offset positions of the strip segments of different wall thicknesses; and positioning a cut contour for the cutting in step (b) precisely using the positions marked on the strip.

3. The component defined in claim 1, the method further comprising the step of providing in the strip at thinner segments thereof, for the cutting in step (b), formations compensating for thickness differences in the strip and facilitating stacking thereof.

4. The component defined in claim 3 wherein the formations are corrugations.

5. An elongated structural component having regions of different thicknesses along a length thereof matched to different loads to be applied to the component, the component being made by a method comprising the steps of sequentially:

(a) longitudinally rolling flexible metal strip so as to form along a length thereof transversely extending rolled strip segments of different wall thickness;

(b) cutting from the flexible rolled strip sheet bars extending longitudinally across a plurality of the segments and therefore having regions of the different wall thicknesses formed by rolling in step (a) and matched to the different loads to be applied to the component;

(b') providing in the strip at thinner segments thereof transversely extending corrugations compensating for thickness differences in the strip and facilitating stacking thereof;

©) reshaping each sheet bar cut from the rolled strip in step (b) to a final configuration of the respective structural component in at least one forming step in at least one hot-forming tool; and (d) hardening the respective reshaped sheet bar thereof in the respective hot-forming tool.

6. The component defined in claim 5, the method further comprising the steps of:

marking longitudinally offset positions of strip segments of different wall thicknesses prior to cutting step (b); and in cutting step (b) positioning a cut contour precisely using the positions marked on the strip.

* * * * *

US007546755C1

(12) EX PARTE REEXAMINATION CERTIFICATE (9358th)

United States Patent
Arns

(10) Number: US 7,546,755 C1
(45) Certificate Issued: Oct. 9, 2012

(54) STRUCTURAL COMPONENT

(75) Inventor: Wilhelm Arns, Paderborn (DE)

(73) Assignee: Benteler Automobiltechnik GmbH, Paderborn (DE)

Reexamination Request:
No. 90/009,926, Jul. 21, 2011

Reexamination Certificate for:

| | |
|---|---|
| Patent No.: | **7,546,755** |
| Issued: | **Jun. 16, 2009** |
| Appl. No.: | **11/652,189** |
| Filed: | **Jan. 11, 2007** |

Related U.S. Application Data

(62) Division of application No. 10/666,958, filed on Sep. 19, 2003, now Pat. No. 7,181,948.

(30) Foreign Application Priority Data

Oct. 2, 2002 (DE) ..... 102 46 164

(51) Int. Cl.
*B21B 1/00* (2006.01)

(52) U.S. Cl. ..... 72/203; 72/206; 72/240; 72/365.2

(58) Field of Classification Search ..... 72/200, 72/203, 206, 240, 365.2
See application file for complete search history.

(56) References Cited

To view the complete listing of prior art documents cited during the proceeding for Reexamination Control Number 90/009,926, please refer to the USPTO's public Patent Application Information Retrieval (PAIR) system under the Display References tab.

*Primary Examiner* — Jimmy G Foster

(57) ABSTRACT

Elongated structural components having regions of different thicknesses, especially for use in automobile bodies, are produced by flexible rolling metal strip so as to form along a length thereof rolled-strip segments of different wall thickness. The sheet bars are cut from the rolled strip and have regions of different wall thickness. Each sheet bar is reshaped in at least one hot-forming tool in at least one hot-forming state and the reshaped sheet bar is then rapidly cooled in the hot-forming tool of the last reshaping stage.

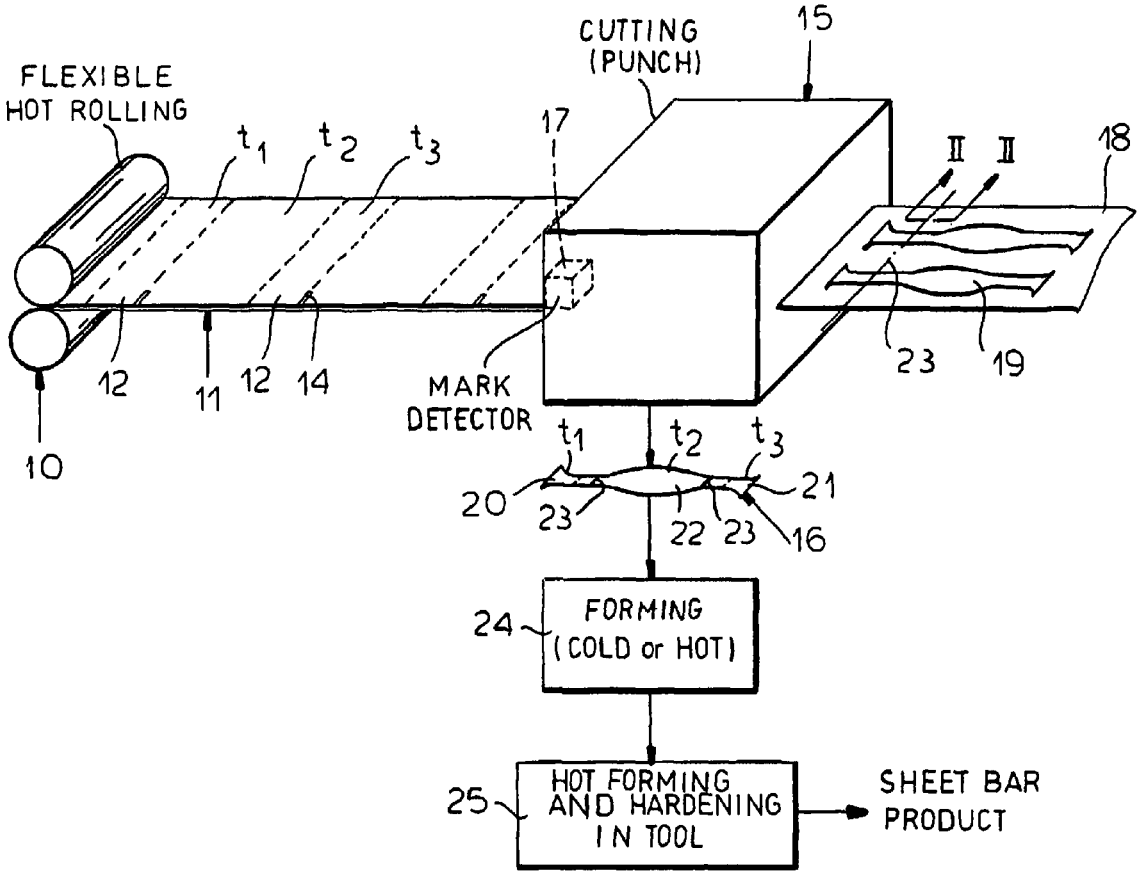

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claims 1, 4 and 5 are determined to be patentable as amended.

Claims 2 and 6, dependent on an amended claim, are determined to be patentable.

1. An elongated structural component [having] *that is press hardened and that has* regions of different thicknesses along a length thereof matched to different loads to be applied to the component, the component being made by a method comprising the steps of:

(a) longitudinally rolling metal strip so as to form along a length thereof transversely extending rolled strip segments of different wall thickness;

(b) cutting from the rolled strip sheet bars extending longitudinally across a plurality of the segments and therefore having regions of the different wall thicknesses formed by rolling in step (a) and matched to the different loads to be applied to the component *and providing in the strip at thinner segments thereof formations compensating for thickness differences in the strip and facilitating stacking thereof*;

[©] *(c)* reshaping each sheet bar cut from the rolled strip in step (b) to a final configuration of the respective structural component in at least one forming step in at least one hot-forming tool; and (d) hardening the respective reshaped sheet bar thereof in the respective hot-forming tool.

4. The component defined in claim [3] *1* wherein the formations are corrugations.

5. An elongated structural *steel* component [having] *that is press hardened and that has* regions of different thicknesses along a length thereof matched to different loads to be applied to the component *and at thinner segments transversely extending corrugations compensating for thickness differences in the strip and facilitating stacking thereof*, the component being made by a method comprising the steps of sequentially:

(a) longitudinally rolling flexible metal strip so as to form along a length thereof transversely extending rolled strip segments of different wall thickness;

(b) cutting from the flexible rolled strip sheet bars extending longitudinally across a plurality of the segments and therefore having regions of the different wall thicknesses formed by rolling in step (a) and matched to the different loads to be applied to the component; (b') providing in the strip at thinner segments thereof transversely extending corrugations compensating for thickness differences in the strip and facilitating stacking thereof;

[©] *(c)* reshaping each sheet bar cut from the rolled strip in step (b) to a final configuration of the respective structural component in at least one forming step in at least one hot-forming tool; and (d) hardening the respective reshaped sheet bar thereof in the respective hot-forming tool.

* * * * *